United States Patent [19]

Reyna

[11] Patent Number: 4,708,418

[45] Date of Patent: Nov. 24, 1987

[54] ELECTRICAL CONNECTION

[76] Inventor: Johnny F. Reyna, 1001 Whitehall Dr., Plano, Tex. 75023

[21] Appl. No.: 833,240

[22] Filed: Feb. 27, 1986

[51] Int. Cl.[4] ..... H01R 4/46

[52] U.S. Cl. ..... 439/785; 439/797; 439/805; 439/804

[58] Field of Search ..... 339/242, 246, 248 R, 339/249 R, 249 A, 265 R, 268 R, 272 R, 272 A

[56] References Cited

U.S. PATENT DOCUMENTS

| | | | |
|---|---|---|---|
| 779,469 | 1/1905 | Dossert | 403/308 |
| 1,093,972 | 4/1914 | Cady | 339/248 |
| 1,267,959 | 5/1918 | Becker | 403/233 |
| 1,382,829 | 6/1921 | Gilbert | 403/344 |
| 1,960,153 | 5/1934 | Hixon et al. | 339/265 R |
| 1,981,685 | 11/1934 | Blackburn | 173/273 |
| 2,077,613 | 4/1937 | Bondeson | 339/13 |
| 2,134,623 | 10/1938 | Rowe | 339/272 R |
| 2,164,022 | 6/1939 | Rowe | 339/265 R |
| 3,617,616 | 11/1971 | O'Loughlin | 174/94 |
| 3,816,817 | 6/1974 | Ball et al. | 339/242 |
| 3,988,052 | 10/1976 | Mooney et al. | 339/265 R |
| 4,034,151 | 7/1977 | Silva | 339/59 R |
| 4,169,652 | 10/1979 | Höckele et al. | 339/246 |

*Primary Examiner*—Gil Weidenfeld
*Assistant Examiner*—Paula A. Austin
*Attorney, Agent, or Firm*—William H. Schultz

[57] ABSTRACT

This invention comprises a connection between a plurality of electrical conductors such as a mainline conductor and a tap or branch line conductor. The connection utilizes a connector comprising a pair of members which clampingly engage one conductor. One of the clamping members includes means for engagement with another conductor. The clamping members are smoothly contoured and free of sharp edges and all other parts are completely recessed within the clamping members when the connector is installed to prevent interference with or damage to insulation applied to the connection.

29 Claims, 14 Drawing Figures

ELECTRICAL CONNECTION

This invention is directed generally to electrical connections and specifically to a connection between an intermediate portion of a main line conductor and a tap or branch line and to a connector for use in making such connection.

BACKGROUND OF THE INVENTION

It is frequently necessary to connect the end of a tap or branch line to an intermediate portion of an electrical conductor in order to supply electrical energy for any required purpose such as for operating lights, signals, meters, etc. If the mainline conductor is insulated, as is often the case, it is necessary to remove a portion of the insulation in order to effect the connection. After the connection has been made it is usually desirable, and in many cases necessary, to insulate the connection with an approved insulating means such as electrical tape or a preformed insulating sleeve or jacket. It is imperative that the conection provide a secure mechanical joint as well as good electrical contact.

OBJECTS OF THE INVENTION

It is an object of this invention to provide an electrical connector which is easy to install, even in a congested space, and which can readily be installed with conventional tools.

It is a further object of this invention to provide an electrical connector which will make good electrical contact as well as a firm mechanical connection with the conductors.

It is a further object of this invention to provide an electrical connector to which insulation may easily be applied and which has no sharp edges or projecting parts which could pierce, cut or otherwise damage the insulation.

It is a further object of the invention to provide an electrical connector which can be made of very short axial length so that a minimum amount of insulation need be removed when attaching the connector to an insulated main line conductor.

It is a further object of this invention to provide a connection between a plurality of electrical conductors using the above mentioned connector.

Other objects will become apparent to those skilled in the art from the following detailed description of the invention and the accompanying drawings in which.

Figure 2:
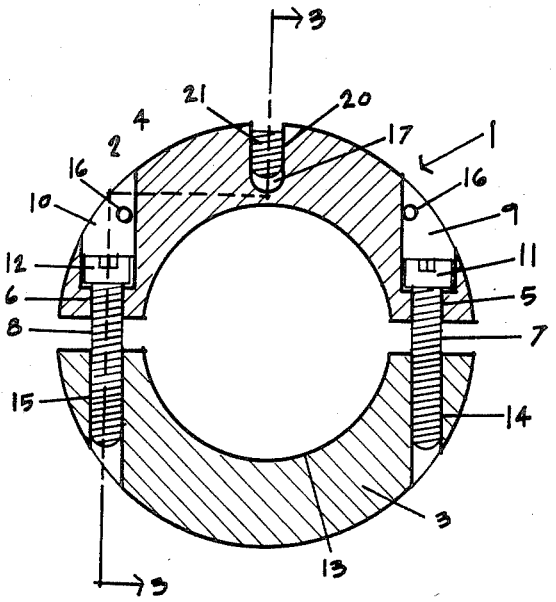
FIG. 2 is a cross-sectional view of the connector taken along line 2—2 of FIG. 1.

Referring to the drawing, the invention as illustrated in FIGS. 1 through 4 comprises a connector 1 which comprises a pair of generally semi-cylindrical clamping members 2 and 3. Member 2 is provided with a concave seat 4 for engagement with a conductor. A pair of bores 5 and 6 are provided on opposite sides of the seat for loosely receiving threaded fasteners 7 and 8 respectively. Immediately adjacent bores 5 and 6 are counter bores 9 and 10 respectively. The counter bores are of such size as to receive the heads 11 and 12 of the threaded fasteners completely so that no part of the fasteners will project beyond the periphery of the member 2 when the conductor is installed. The heads are provided with means for engagement with a complementary tool such as an Allen wrench, screwdriver or other suitable tool. Member 3 is provided with a concave seat 13 for engagement with a conductor. Recesses 14 and 15 having thread engaging means complementary to the threaded shanks of fastening members 7 and 8 are provided on opposite sides of the seat 13 whereby the fastening members 7 and 8 may be engaged with respective recesses and the clamping members 2 and 3 drawn into engagement with a conductor. The thread engaging means in recesses 14 and 15 is preferrably a thread complementary to that of threaded members 7 and 8. However, any suitable means such as an inwardly extending lug or pin may be substituted for the thread, if desired.

While not necessary to the operation of my invention, I prefer to provide each of the counter bores in the member 2 with a retaining means such as a pin 16 for engaging the head of the fastener and preventing removal of the fastener from the member 2 when the fastener is not engaged with a threaded recess in member 3. The length of the fasteners will depend on the dimensions of the members 2 and 3 and on the diameter of the conductor to which the connector is attached. It is important that no part of the fasteners project beyond the periphery of members 2 and 3 when the conductor is installed since such projection could interefere with the application of insulation or could pierce the insulation. Apart from the above considerations it is only necessary that the fasteners be of sufficient length to provide good engagement with the recesses 14 and 15.

Figure 3:
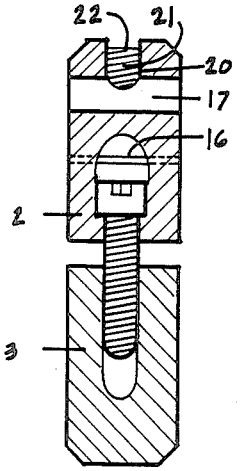
FIG. 3 is a cross-sectional view of the connector taken along line 3—3 of FIG. 2.
Figure 4:
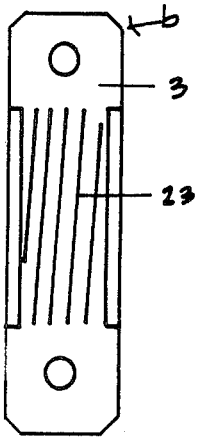
FIG. 4 is a plan view of one of the clamping members which comprises a part of the connector.
Figure 1:
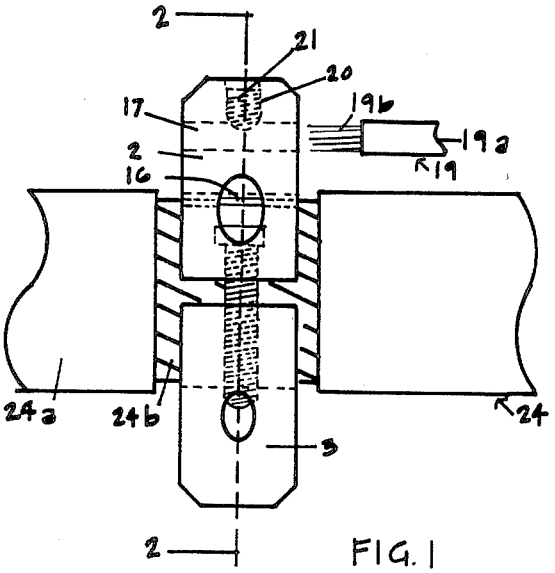
FIG. 1 is a longitudinal view, partly in cross-section, of one form of the connector attached to a main line conductor prior to the attachment of the tap line.

A recess 17 is provided in a radial surface of member 2 for receiving a conductor 19 such as a tap or branch line. This recess will ordinarily extend the entire axial length of member 2 as shown in FIGS. 1 and 3. Such a construction has the advantage of permitting insertion of the conductor 19 from either side of the connector. However, the recess may terminate short of the axial length of the member 2 and still fall within the scope of this invention. Communicating with the recess 17 is a threaded bore 20 which extends to the outer periphery of the member 2 and which receives a complementary set screw 21. This set screw is provided with an arcuate end portion for engagement with the conductor 19 and at the opposite end with means 22 for engagement with a complementary tool and is of sufficiently short length to insure that it will not extend beyond the periphery of member 2 when engaged with conductor 19 which could interfere with the application of or damage to insulation. For this reason, the set screw 21 will ordinarily be shorter than the length of threaded bore 20 although it could be slightly longer if used with a conductor of less diameter than that of recess 17. While the threaded bore 20 and set screw 21 have been illustrated as extending radially with respect to the member 2 they could, if desired, extend at an angle to the radius of curvature of the member 2 and still fall within the scope of this invention. Likewise, while the recess 17 has been shown as extending parallel to the axis of the connector 1, it could, if desired, extend at an angle to this axis. The orientations of the threaded bore, 20, set screw 21 and recess 17 as illustrated are generally the preferred orientations for ease of manufacture and installation. However, other orientations may be preferrable in some cases, for example, to facilitate installation in certain congested areas. Also, the recess 17 and threaded bore 20 could be located in member 3 instead of in member 2, if desired.

In most cases, the ninety degree angle between the radial surface and the circumferential surface of clamping members 2 and 3 will be sufficiently obtuse to prevent damage to the insulation which is usually applied after the connection is made. However, as an additional precaution, against such damage the angle between the radial and circumferential surfaces may be rendered more obtuse by either rounding or bevelling the intersection of these surfaces as at b.

The connector may be made of any axial length desired. However, the preferred simple semi-cylindrical configuration permits this length to be very short which is usually desirable since a short length not only reduces the amount of insulation which must be removed from the main line conductor but also enhances the grip on the main line conductor due to the reduced area of the clamping surfaces. It will be obvious to those skilled in the art that the configuration of members 2 and 3 need not be perfectly semi-cylindrical in order to be operative. The semi-cylindrical configuration is generally preferred for reasons of manufacturing expediency and availability of stock material but may varied slightly, if desired.

While not absolutely necessary, the sets 4 and 13 are preferrably provided with ridges 23 for enhancing the gripping action of the members 2 and 3 on the conductor. I prefer to form these ridges by threading for reasons of manufacturing expediency. However, they may be formed by any convenient method or some other suitable irregular surface such as that formed by knurling, spiking or beading may be substituted.

The manner of using the connector is as follows:

A portion of insulation **24*a* is removed from the conductor 24 to expose a bare portion 24*b*. The length of this bare portion is slightly greater than the axial length of the connector. The two members 2 and 3 are then juxtaposed on opposite sides of the conductor and the fasteners 7 and 8 which serve as actuating means for drawing the clamping members together are threaded into apertures 14 and 15 whereby the members 2 and 3 are drawn into tight engagement with the bare portion 24*b*. A short length of insulation 19*a* is then removed from conductor 19 to expose a bare portion 19*b*. The bare portion 19*b* is then inserted into recess 17 and set screw 21 is tightened until conductor 19 is firmly secured to the member 2. Alternatively, the conductor 19 may be secured to member 2 before members 2 and 3 are secured to conductor 24**, if desired.

Figure 5:
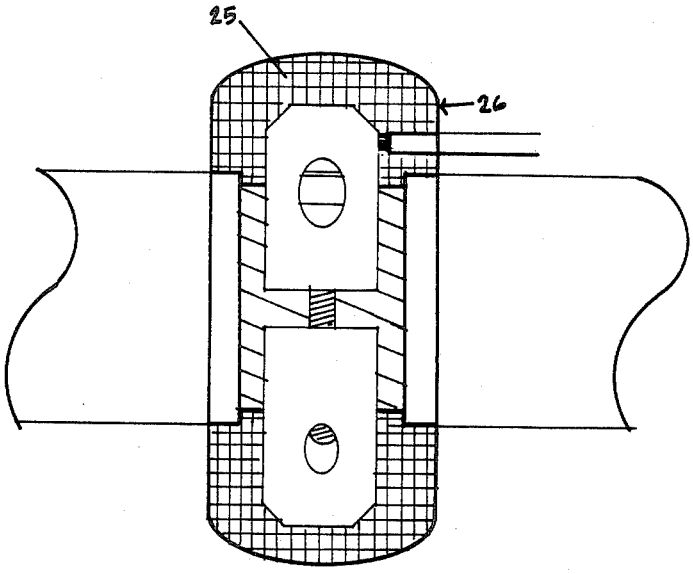
FIG. 5 is a longitudinal view, partly in cross-section, similar to FIG. 1 diagrammatically illustrating the completed connection wrapped with insulating tape.

After the connection has been made, it is usually desirable to cover both the connector and any bare portion of the conductors with insulation. While a number of types of preformed insulating members are available, the smooth and regular surface and the absence of any projecting parts make this connection ideally adapted for wrapping with ordinary insulating tape. As shown diagramatically in FIG. 5 this insulation preferably comprises a plurality of layers of rubber tape surrounded by one or more layers of vinyl tape. The lack of any irregularities on the smoothly contoured surfaces and the absence of projecting parts reduces the tendency of adjacent wrappings to separate without the use of an excessive amount of tape. The absence of any sharp edges together with the lack of projecting parts prevents the tape from being cut or pierced.

Figure 6:
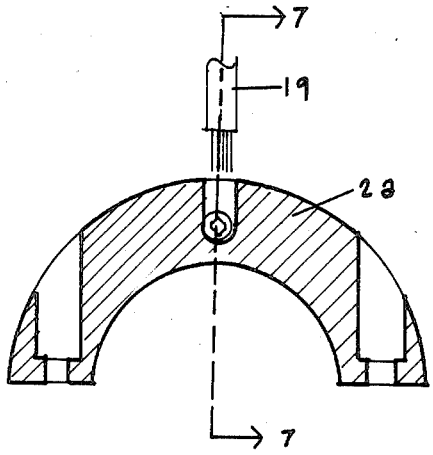
FIG. 6 is a cross-section of a modified clamping member.
Figure 7:
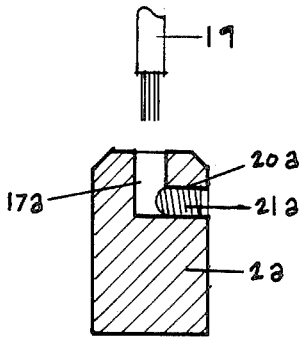
FIG. 7 is a cross-section of the modified clamping member taken along line 7—7 of FIG. 6.

FIGS. 6 and 7 illustrate a modification of the connector wherein the recess **17*a* for receiving the tap wire 19 extends from the circumferential surface of clamping member 2*a*. Threaded bore 20*a* which receives the set screw 21*a* extends from a radial surface of member 2*a*. In all other respects, this modification is identical with that illustrated in FIGS. 1 through 4**.

Figure 8:
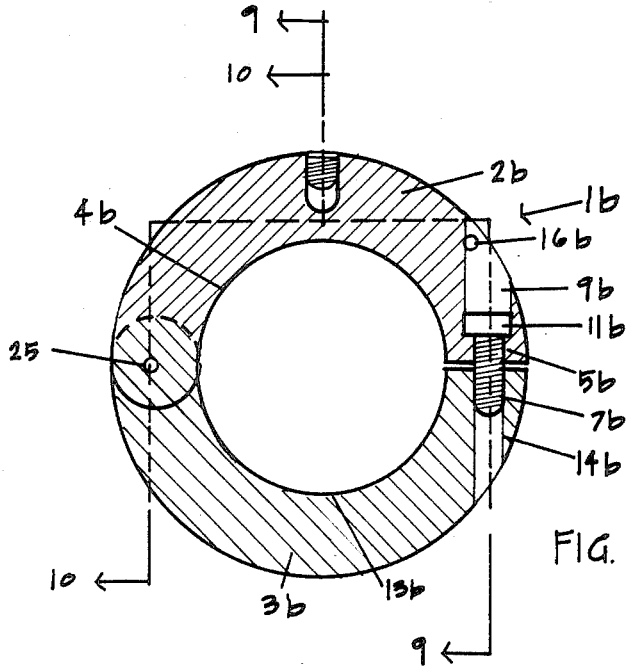
FIG. 8 is a cross-section of another modified form of the connector.
Figure 9:
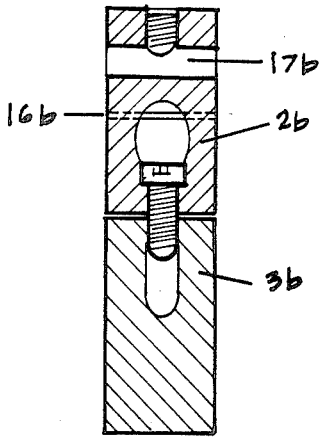
FIG. 9 is a cross-section of the modification shown in FIG. 8 taken along line 9—9.
Figure 10:
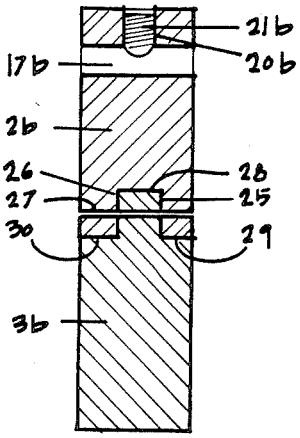
FIG. 10 is a cross-section of the modification of FIG. 8 taken along line 10—10.

FIGS. 8, 9 and 10 illustrate a further modification of the connector. In this form of the invention, the connector **1*b* comprises a pair of generally semi-cylindrical clamping members 2*b* and 3*b* secured together at one end by a pivot means. The clamping members 2*b* and 3*b* are provided with seats 4*b* and 13*b* respectively for engaging a mainline conductor. Clamping member 2*b* is provided with a recess 17*b* for receiving a tap or branch line conductor. A set screw 21*b* threadedly engaged with a bore 20*b* serves to anchor the tap line in recess 17*b*. On one side of seat 4*b* the clamping member 2*b* is provided with a recess 25. Clamping member 3*b* is provided with a projection 26 which is complementary to and fits within recess 25. A pivot pin 27 traverses the projection and adjacent portions of clamping member 2*b*, The interfaces 28, 29 and 30 are cylindrically curved about the axis of pivot pin 27 to permit clamping members 2*b* and 3*b* to pivot freely about pin 27. On the opposite side of the seats members 2*b* and 3*b* are connected by a threaded fastener 7*b* which is loosely received in bore 5*b* in clamping member 2*b* and threadedly engaged with bore 14*b* in clamping member 3*b*. The fastener 7*b* serves as an actuating means for drawing the clamping members 2*b* and 3*b* into engagement with a conductor. Bore 5*b* includes a counterbore 9*b* for receiving the head 11*b* of the threaded fastener. Preferably, a retaining pin 16*b* is provided in the counter bore 9*b* to prevent the removal of threaded fastener 7*b* when the fastener is not engaged with the recess 14*b*. As in the modification of FIGS. 1 through 4 the threaded fastener 7*b* is completely recessed within the clamping members when the connector is installed. The clamping members can not pivot about pin 27 unless the threaded fastener 7*b* is completely disengaged from the recess 14*b*. Therefore, if a retaining pin 16*b* is provided in the counter bore 9*b* sufficient head room must be provided for the fastener, that is, when the head of the fastener is seated against the bottom of the counter bore the length of the portion of the fastener which is received in the threaded recess of member 3*b* must not be greater than the distance between the head 11***b* and the retaining pin. A convenient length is that wherein the length of the portion of fastener 7*b* which extends beyond member 2*b* when the head of the fastener is seated against the bottom of the counterbore is equal to or slightly less than the distance between the head and the retaining pin. Also, as in the modification of FIGS. 1 through 4, this form of the invention is smoothly contoured so as to present no sharp edges and all parts are recessed within the clamping members so that no part of the connector projects beyond the periphery of the clamping members. Also, as in the modification of FIGS. 1 through 4, the edges of the clamping members may be rounded or bevelled, if desired.

Figure 11:
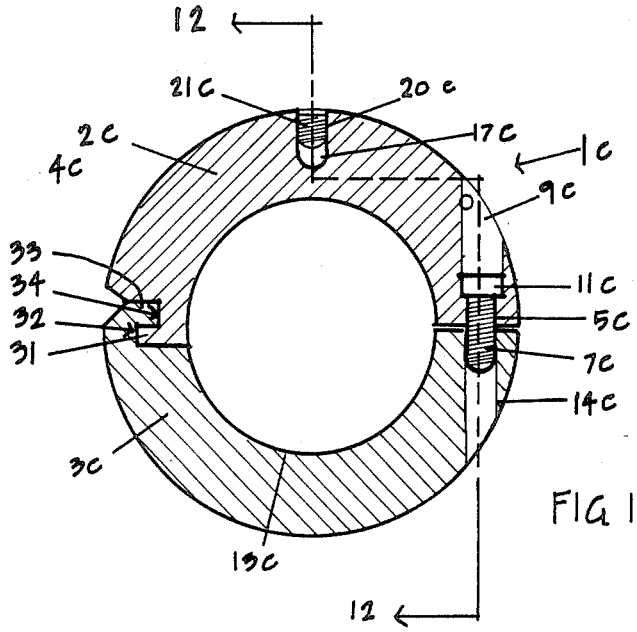
FIG. 11 is a cross-section of a further modification of the connector.
Figure 13:
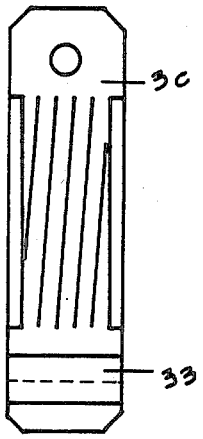
Figure 12:
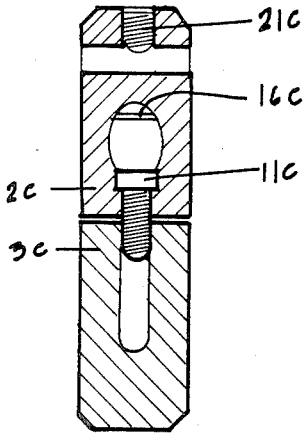
FIG. 12 is a cross-section of the modification shown in FIG. 11 taken along line 12—12.

FIGS. 11 through 13 illustrate a further modification of the connector. In this form of the invention, the connector 1*c* comprises a pair of clamping members 2*c* and 3*c* which are provided with seats 4*c* and 13*c* respectively. The clamping members are secured together on one side of the seats by a scarf or side-slide joint and on the opposite side by a threaded fastener 7*c*. As in previous modifications, the threaded fastener serves as an actuating means for drawing the clamping members into engagement with a conductor. The scarf or side-slide joint comprises a tongue 31 projecting from clamping member 2*c* and received in a complementary recess 32 in clamping member 3*c* and a tongue 33 projecting from clamping member 3*c* and received in a complementary recess 34 in clamping member 2*c*. The threaded fastener is loosely received in bore 5*c* in clamping member 2*c* and threadedly engaged in bore 14*c* of clamping member 3*c*. The bore 5*c* includes a counterbore 9*c* for receiving a head 11*c* on the fastener 7*c*. A retaining pin 16*c* for preventing removal of threaded fastener 7*c* from clamping member 2*c* when the fastener is not engaged with bore 14*c* may be provided, if desired. As in previous modifications, the length of the threaded fastener is not critical. It is only necessary that it be of sufficient length to provide good engagement with bore 14*c*, that no part of the fastener extend beyond the periphery of clamping members 2*c* and 13*c* when installed and that if a retaining pin 16*c* is provided in counterbore 9*c* sufficient head room between the pin and head 11*c* be provided. Sufficient play is provided in the scarf or side-slide joint to permit the clamping members to rock slightly in a radial plane so that they may pivot at the locus of the joint when the fastener 7*c* is tightened or loosened. As in other modifications, the edges of the clamping members may be rendered more obtuse by rounding or bevelling, if desired.

Figure 14:
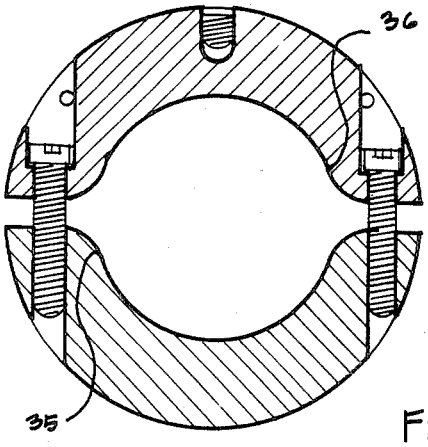
FIG. 13 is a plan view of one of the clamping members of the connector illustrated in FIGS. 11 and 12 and FIG. 14 is a cross-section of a further modification of the connector.

As shown in FIG. 14, the seats may be flared toward their extremities. The flared portions 34 and 35 may be either curvilinear or planar, and may occupy as much of the seats as desired. This feature is very desirable since it permits a single connector to be used with a wide range of mainline conductor diameters, but may be omitted to simplify manufacture in situations where such flexibility is not necessary. Although FIG. 14 shows the flared seats in clamping members of the type illustrated in FIGS. 1 through 4 they are compatible with and may be used with any of the clamping members disclosed in this specification.

While the reversed position of the conductor receiving recess and the threaded set screw receiving bore has been illustrated only in clamping members of the type shown in FIGS. 1 through 4, it will be readily appreciated by those skilled in the art that this feature could be used in conjunction with the clamping members illustrated in any of the other figures.

The connector may be made of any material which has the requisite strength and electrical conductivity such as, copper, brass, aluminum, aluminum alloy, etc. A particularly desirable material is an aluminum alloy designated commercially as 6061T6 which is plated with tin and is very satisfactory when used with either copper or aluminum conductors. Though seldom necessary, it may sometimes be desirable to solder the conductors and connector after making the connection. In this case, the connector would be made of a material which bonds readily to solder.

Many other modifications and uses of my invention will be apparent to those skilled in the art. For example, while my connector is particularly adapted to be insulated with ordinary electrical tape and I generally prefer this to other types of insulation because of its low cost and ready availability there may be installations wherein a preformed insulating element such as a split or segmental insulating sleeve or a casing containing a plastic compound is desirable. Examples of such preformed insulating elements are described in U.S. Pat. Nos. 4,550,220; 2,894,056; and 4,061,872 respectively. Therefore, while I have discussed certain specific embodiments of my invention, I do not intend to be limited to the precise structure described above since many variations are possible without departing from the spirit of my invention. Rather, it is my intention that I be limited only by the appended claims and that my claims be interpreted as broadly as the state of the art will permit.

I claim as my invention:

1. An electrical connector comprising first and second relatively movable clamping members, each clamping member having a concave inner surface forming a seat for engagement with an electrical conductor, said clamping member being secured together by a first securing means adjacent one side of the seats and by an actuating means adjacent the opposite side of the seats, said actuating means being adapted to draw the clamping members toward each other whereby a conductor may be firmly gripped within the seats, a recess formed in one of the clamping members for receiving a second conductor and second securing means for firmly securing the second conductor in said recess, said first securing means, actuating means and secondsecuring means being completely recessed within the periphery of the clamping members whereby insulation may be applied to the connector after the connection is made without damage thereto or interference therewith due to contact with said first or second securing means or said actuating means.

2. An electrical connector according to claim 1, wherein the securing means comprises a scarf joint.

3. An electrical connector according to claim 1, wherein the recess extends from a radial surface on the clamping member.

4. An electrical connector according to claim 1, wherein the recess extends from a circumferential surface of the clamping member.

5. An electrical connector according to claim 1, wherein the actuating means is a screw.

6. An electrical connector according to claim 1, wherein the second securing means is transverse to said recess.

7. An electrical connector according to claim 1, wherein the second securing means is a set screw which is received in a threaded bore communicating with said recess.

8. An electrical connector according to claim 1, wherein the first securing means comprises a second actuating means.

9. An electrical connector according to claim 8, wherein the clamping members are separable from each other and the actuating means comprises a pair of threaded members, each threaded member being loosely received in a respective bore in said first clamping member and said second clamping member comprising a pair of bores for receiving said threaded members, each of said second mentioned bores having complementary engaging means for operatively coacting with a threaded member to draw said clamping members together.

10. An electrical connector according to claim 1, wherein the securing means comprises a pivotal connection between the clamping members.

11. An electrical connector according to claim 10 wherein the axis of the pivotal connection extends at an angle of substantially ninety degrees to the direction of actuation of the actuating means.

12. An electrical connector according to claim 1, wherein the actuating means comprises an elongated actuating member, and the first clamping member is provided with a first bore for loosely receiving the actuating member and the second clamping member is provided with a second bore, said second bore comprising means operatively engageable with means on the actuating member for drawing the clamping members toward each other.

13. An electrical connector according to claim 12, wherein the first bore comprises an enlarged counterbore for accommodating a head on the actuating member.

14. An electrical connector according to claim 12, wherein the first clamping member comprises retaining means for preventing the actuating member from separating therefrom.

15. An electrical connector according to claim 14, wherein the retaining means comprises a pin transverse to the axis of the first bore.

16. An electrical connector comprising first and second generally semi-cylindrical clamping members, each clamping member having a concave inner surface forming a seat for engagement with an electrical conductor, said first clamping member having a bore on each side of the seat, a threaded member loosely received in each bore, an enlarged counterbore adjacent each bore in said first clamping member for loosely and completely receiving a head on the threaded member, said second clamping member having a bore on each side of the seat for receiving a threaded member, each of the bores in the second clamping member comprising means for operatively engaging a respective threaded member, whereby said clamping members may be drawn into firm electrical and mechanical engagement with a conductor and means associated with one of said clamping members for engagement with a second electrical conductor, said threaded members and means for engagement with said second electrical conductor being configured and dimensioned so as to be completely recessed within the periphery of the clamping members, whereby insulation may be applied to the connector without damage thereto or interference therewith due to contact with the threaded members or the means for engagement with the second electrical conductor.

17. An electrical connector according to claim 16, wherein the means for receiving the second connector comprises a recess in one of the clamping members.

18. An electrical connector comprising first and second generally semi-cylindrical clamping members, each clamping member having a concave inner surface forming a seat for engagement with an electrical conductor, said first clamping member having a bore on each side of the seat, a threaded member loosely received in each bore, an enlarged counterbore adjacent each bore in said first clamping member for loosely receiving a head on the threaded member, said second clamping member having a bore on each side of the seat for receiving a threaded member, each of the bores in the second clamping member comprising means for operatively engaging a respective threaded member whereby said clamping members may be drawn into firm electrical and mechanical engagement with a conductor and means associated with one of said clamping members for engagement with a second electrical conductor, the first clamping member being provided with means for preventing separation of the threaded members therefrom.

19. A connection between a plurality of electrical conductors comprising an insulated main line conductor and a tap line conductor, a section of insulation being removed from an intermediate portion of said main line conductor to provide a bare conductor surface, first and second relatively movable clamping members, each clamping member having a concave inner surface forming a seat in engagement with said bare conductor surface of said main line conductor, said clamping members being connected together by a first securing means adjacent one side of the seats and by an actuating means on the opposite side of the seats, said actuating means being adapted to draw the clamping members toward each other into firm electrical and mechanical contact with said main line conductor, one of said clamping members comprising means for firmly engaging said tap line conductor electrically and mechanically, and electrically insulating means surrounding said connection, said first securing means, actuating means and tap line engaging means being completely recessed within the periphery of the clamping members to prevent interference with or damage to said electrically insulating means.

20. A connection between a plurality of electrical conductors according to claim 19, wherein said insulating means comprises a preformed jacket.

21. A connection between a plurality of electrical conductors according to claim 19 wherein said electrically insulating means comprises electrical tape wrapped about said conductors and clamping members.

22. A connection between a plurality of electrical conductors according to claim 19, wherein the securing means comprises a second actuating means.

23. A connection between a plurality of electrical conductors according to claim 19, wherein the securing means comprises a pivotal connection between the clamping members.

24. A connection between a plurality of electrical conductors according to claim 19, wherein the securing means comprises a scarf joint.

25. A connection between a plurality of electrical conductors according to claim 19, wherein the means for engaging the tap line conductor comprises a recess extending inwardly from a radial surface of one of the clamping members.

26. A connection between a plurality of electrical conductors according to claim 19, wherein the means for engaging the tap line conductor comprises a recess extending inwardly from a circumferential surface of one of the clamping members.

27. A connection between a plurality of electrical conductors according to claim 19, wherein the clamping members are separable from each other, said first clamping member is provided with a bore on each side of the seat and the the first securing means comprises a second actuating means, said first and second actuating means comprises a pair of threaded members, each threaded member being loosely received in a respective bore in said first clamping member and said second clamping member comprises a pair of bores, each of said second mentioned bores receiving a respective threaded member and having complementary engaging means operatively coacting with the threaded member.

28. A connection between a plurality of electrical conductors according to claim 19, wherein the first clamping member is provided with a first bore for loosely receiving the actuating member and the second clamping member is provided with a second bore, said second bore comprising means operatively engageable with means on the actuating member for drawing the clamping members toward each other.

29. A connection between a plurality of electrical connectors according to claim 28, wherein the first bore comprises an enlarged counterbore for accommodating an enlarged head on the actuating member.

* * * * *

UNITED STATES PATENT AND TRADEMARK OFFICE

CERTIFICATE OF CORRECTION

PATENT NO. : 4,708,418

DATED : Nov. 24, 1987

INVENTOR(S) : Johnny F. Reyna

It is certified that error appears in the above-identified patent and that said Letters Patent is hereby corrected as shown below:

Column 1, line 51: ", partly in cross-section," should be cancelled.

Column 3, line 49: "sets" should read --seats--.

Column 5, line 19: --Clamping member 2c is provided with a recess 17c for receiving a tap or branch line conductor. A set screw 21c threadedly engaged with a bore 20c serves to anchor the tap or branch line conductor-- should be inserted after the period.

Column 5, line 42: "13c" should read --3c--.

Column 5, line 53: "34 and 35" should read --35 and 36--.

Claim 1, line 5 (Column 6, line 38) "member" should read --members--.

Claim 27, line 7 (Column 9, line 12) "comprises" should read --comprising--.

Signed and Sealed this

Nineteenth Day of April, 1988

*Attest:*

*Attesting Officer*

DONALD J. QUIGG

*Commissioner of Patents and Trademarks*